US008212746B2

(12) United States Patent
Akamatsu et al.

(10) Patent No.: US 8,212,746 B2
(45) Date of Patent: Jul. 3, 2012

(54) METHOD FOR DRIVING A PLASMA DISPLAY PANEL BY USING A HOLDING PERIOD BETWEEN SUBFIELD GROUPS

(75) Inventors: Keiji Akamatsu, Osaka (JP); Minoru Takeda, Osaka (JP); Kenji Ogawa, Osaka (JP); Hiroshi Ibaraki, Osaka (JP)

(73) Assignee: Panasonic Corporation, Osaka (JP)

( * ) Notice: Subject to any disclaimer, the term of this patent is extended or adjusted under 35 U.S.C. 154(b) by 616 days.

(21) Appl. No.: 12/300,405

(22) PCT Filed: Apr. 10, 2008

(86) PCT No.: PCT/JP2008/000931
§ 371 (c)(1),
(2), (4) Date: Nov. 11, 2008

(87) PCT Pub. No.: WO2008/129871
PCT Pub. Date: Oct. 30, 2008

(65) Prior Publication Data

US 2009/0179877 A1 Jul. 16, 2009

(30) Foreign Application Priority Data

Apr. 18, 2007 (JP) ..... 2007-108888

(51) Int. Cl.
*G09G 3/28* (2006.01)

(52) U.S. Cl. ..... 345/60; 345/63

(58) Field of Classification Search ..... 345/60–72, 345/208, 210–215, 690–693; 315/169.4
See application file for complete search history.

(56) References Cited

U.S. PATENT DOCUMENTS

2003/0218580 A1* 11/2003 Yokoyama et al. ..... 345/60
2004/0032533 A1* 2/2004 Correa et al. ..... 348/618
2005/0264230 A1* 12/2005 Kim et al. ..... 315/169.4
(Continued)

FOREIGN PATENT DOCUMENTS

EP 1 710 775 A2 10/2006
(Continued)

OTHER PUBLICATIONS

Supplementary European Search Report for Application No. EP 08 73 8543, Jan. 19, 2011, Panasonic Corporation.

(Continued)

*Primary Examiner* — Chanh Nguyen
*Assistant Examiner* — Navin Lingaraju
(74) *Attorney, Agent, or Firm* — RatnerPrestia

(57) ABSTRACT

In a driving method of a panel, one field period is formed by arranging a plurality of subfields that have an initializing period for causing initializing discharge in a discharge cell, an address period for selectively causing address discharge in the discharge cell, and a sustain period for causing as many sustain discharges as the number corresponding to luminance weight in the discharge cell. One field period is formed by arranging a plurality of subfield groups having a plurality of subfields whose luminance weights monotonically increase. A holding period when discharge is not caused is disposed before the head subfield belonging to at least one subfield group of the plurality of subfield groups. In the initializing period of the head subfield belonging to at least one subfield group, an initializing operation of causing initializing discharge is performed in the discharge cell where the sustain discharge has been performed in the sustain period of the immediately preceding subfield.

4 Claims, 7 Drawing Sheets

U.S. PATENT DOCUMENTS

| | | | | |
|---|---|---|---|---|
| 2005/0264483 | A1* | 12/2005 | Jeong | 345/63 |
| 2006/0227075 | A1* | 10/2006 | Kim | 345/63 |
| 2006/0227076 | A1* | 10/2006 | Kim | 345/63 |
| 2006/0227253 | A1* | 10/2006 | Kim | 348/739 |
| 2007/0030214 | A1* | 2/2007 | Kim | 345/67 |
| 2009/0015520 | A1 | 1/2009 | Akamatsu et al. | |

FOREIGN PATENT DOCUMENTS

| | | | |
|---|---|---|---|
| EP | 1 710 777 | A2 | 10/2006 |
| EP | 1 715 469 | A2 | 10/2006 |
| EP | 1 729 278 | A2 | 12/2006 |
| JP | 2000-242224 | A | 9/2000 |
| JP | 2004-157291 | A | 6/2004 |
| JP | 2006-293303 | A | 10/2006 |
| JP | 2006-293318 | A | 10/2006 |
| JP | 2006-301571 | A | 11/2006 |
| JP | 2007-078946 | A | 3/2007 |
| WO | WO 02/45062 | A1 | 6/2002 |
| WO | WO 2006/112233 | A1 | 10/2006 |

OTHER PUBLICATIONS

International Search Report for International Application No. PCT/JP2008/000931, May 20, 2008, Panasonic Corporation.

European Communication for Application No. 08 738 543.1, Aug. 29, 2011, Panasonic Corporation.

* cited by examiner

FIG. 6

Luminance weight

| Subfield / Gradation | 1 | 2 | 3 | 4 | 5 | 6 | 7 | 8 | 9 | 10 | 11 | 12 |
|---|---|---|---|---|---|---|---|---|---|---|---|---|
| | 1 | 2 | 4 | 8 | 16 | 36 | 56 | 4 | 8 | 18 | 40 | 62 |
| 0 | | | | | | | | | | | | |
| 1 | 1 | | | | | | | | | | | |
| 3 | 1 | 1 | | | | | | | | | | |
| 5 | 1 | | 1 | | | | | | | | | |
| 7 | 1 | 1 | 1 | | | | | | | | | |
| 11 | 1 | 1 | 1 | | | | | 1 | | | | |
| 15 | 1 | 1 | | 1 | | | | 1 | | | | |
| 17 | 1 | | 1 | 1 | | | | 1 | | | | |
| 25 | 1 | | 1 | 1 | | | | 1 | 1 | | | |
| 27 | 1 | 1 | 1 | 1 | | | | 1 | 1 | | | |
| 35 | 1 | | 1 | 1 | | | | 1 | | 1 | | |
| 37 | 1 | 1 | 1 | 1 | | | | 1 | | 1 | | |
| 45 | 1 | 1 | 1 | | 1 | | | 1 | | 1 | | |
| 53 | 1 | 1 | 1 | 1 | 1 | | | 1 | | 1 | | |
| 129 | 1 | 1 | 1 | 1 | 1 | 1 | | 1 | | 1 | 1 | |
| 151 | 1 | 1 | 1 | 1 | 1 | 1 | | 1 | | 1 | | 1 |
| 159 | 1 | 1 | 1 | 1 | 1 | 1 | | 1 | 1 | 1 | | 1 |
| 179 | 1 | 1 | 1 | 1 | 1 | | 1 | 1 | 1 | 1 | | 1 |
| 199 | 1 | 1 | 1 | 1 | | 1 | 1 | 1 | 1 | 1 | | 1 |
| 215 | 1 | 1 | 1 | 1 | 1 | 1 | 1 | 1 | 1 | 1 | | 1 |
| 229 | 1 | 1 | 1 | | 1 | 1 | 1 | 1 | 1 | | 1 | 1 |
| 247 | 1 | 1 | 1 | 1 | 1 | 1 | 1 | 1 | | 1 | 1 | 1 |
| 255 | 1 | 1 | 1 | 1 | 1 | 1 | 1 | 1 | 1 | 1 | 1 | 1 |

METHOD FOR DRIVING A PLASMA DISPLAY PANEL BY USING A HOLDING PERIOD BETWEEN SUBFIELD GROUPS

THIS APPLICATION IS A U.S. NATIONAL PHASE APPLICATION OF PCT INTERNATIONAL APPLICATION PCT/JP2008/000931.

TECHNICAL FIELD

The present invention relates to a driving method of a plasma display panel that is used in a wall-hanging television (TV) or a large monitor.

BACKGROUND ART

A typical alternating-current surface discharge type panel used as a plasma display panel (hereinafter referred to as "panel") has many discharge cells between a front plate and a back plate that are faced to each other. The front plate has a plurality of display electrode pairs each of which is formed of a pair of scan electrode and sustain electrode. The back plate has a plurality of parallel data electrodes. In the panel having this structure, ultraviolet rays are emitted by gas discharge in the discharge cells. The ultraviolet rays excite respective phosphor layers of red, green, and blue to emit light, and thus provide color display.

A subfield method is generally used as a method of driving the panel. In this method, one field period is divided into a plurality of subfields, and the subfields at which light is emitted are combined, thereby performing gradation display. Each subfield has an initializing period, an address period, and a sustain period. In the initializing period, initializing discharge occurs, and a wall charge required for a subsequent address operation is formed. In the address period, address discharge is selectively caused in a discharge cell where display is to be performed, thereby forming a wall charge. In the sustain period, a sustain pulse is alternately applied to the display electrode pairs formed of the scan electrodes and the sustain electrodes, sustain discharge is caused, and a phosphor layer of the corresponding discharge cell is light-emitted, thereby displaying an image.

Of the subfield method, a new driving method is disclosed where light emission that is not related to gradation display is minimized and the contrast ratio is improved (patent document 1, for example). In this driving method, the initializing discharge is performed using a gradually varying voltage waveform, and the initializing discharge is selectively applied to the discharge cell having performed sustain discharge.

The screen size and definition of the panel have been recently increased, and the discharge cells have been further fined. As the discharge cells are fined, it becomes difficult to control the wall charge of the discharge cells, and an operation failure, such as a failure that address discharge does not occur in the discharge cell where an address operation is to be performed, occurs, and the image display quality can be reduced.

[Patent document 1] Japanese Patent Unexamined Publication No. 2000-242224

SUMMARY OF THE INVENTION

The present invention provides a driving method of the panel in order to address the above-mentioned problems. This driving method uses a panel having a plurality of discharge cells. Each discharge cell has a data electrode and a display electrode pair that is formed of a scan electrode and a sustain electrode. In the driving method, one field period is formed by arranging a plurality of subfields. Each of the subfields has the following periods:

- an initializing period for causing initializing discharge in a discharge cell;
- an address period for selectively causing address discharge in the discharge cell; and
- a sustain period for causing as many sustain discharges as the number corresponding to luminance weight in the discharge cell.

In this driving method, one field period is formed by arranging a plurality of subfield groups having a plurality of subfields that are arranged so that the luminance weight monotonically increases. A holding period when discharge is not caused is formed before the head subfield belonging to at least one subfield group of the plurality of subfield groups. In the initializing period of the head subfield belonging to at least one subfield group, an initializing operation of causing initializing discharge in the discharge cell where the sustain discharge has been performed in the sustain period of the immediately preceding subfield is performed.

Thus, a driving method of the panel can be provided that allows high-quality image display without causing an operation failure even when a high-definition panel is used.

BRIEF DESCRIPTION OF DRAWINGS

FIG. 6 is a diagram showing coding in accordance with the exemplary embodiment.

REFERENCE MARKS IN THE DRAWINGS

Figure 1:
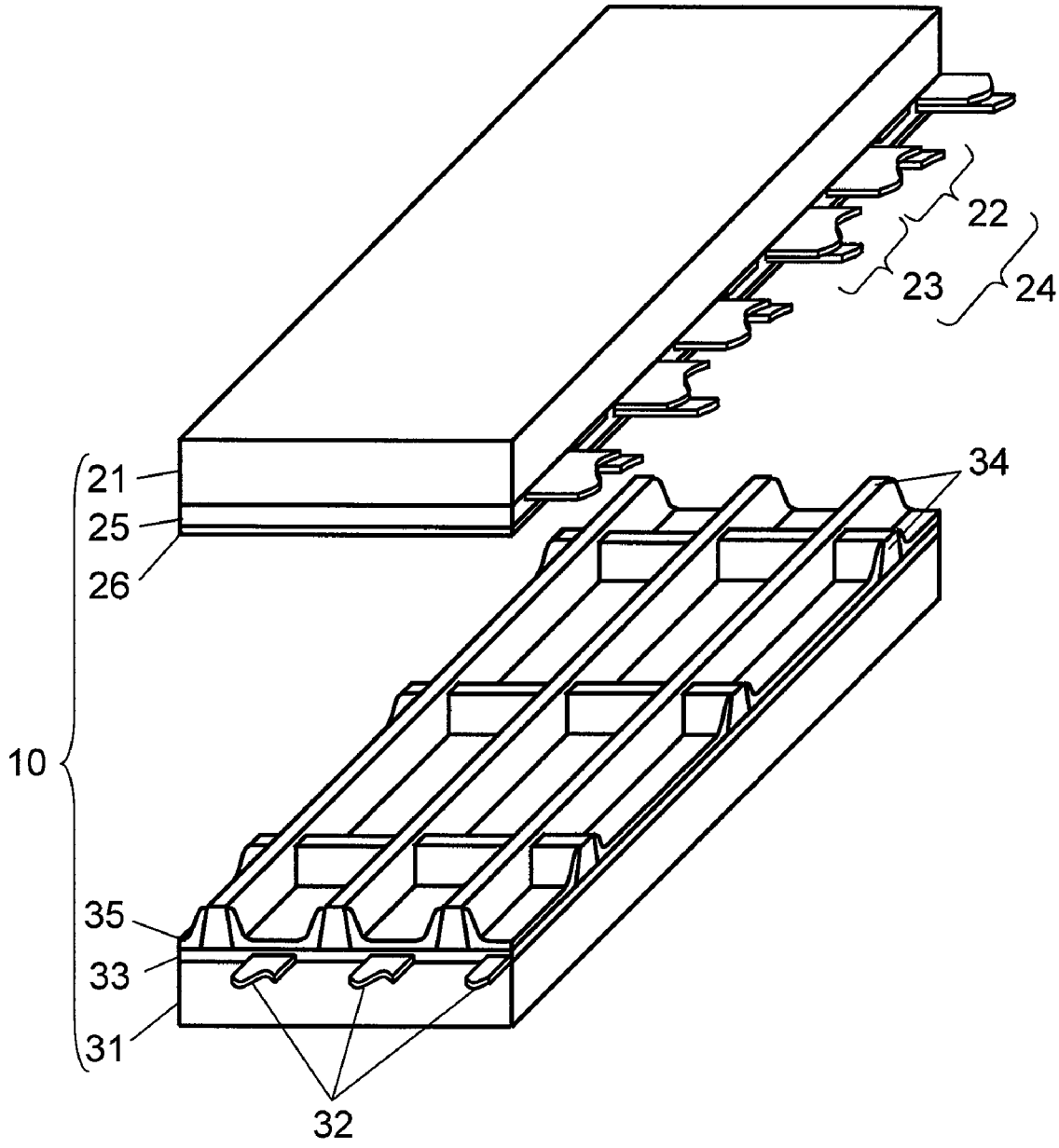
FIG. 1 is an exploded perspective view showing a structure of a panel in accordance with an exemplary embodiment of the present invention.

10 panel
22 scan electrode
23 sustain electrode
24 display electrode pair
32 data electrode
51 image signal processing circuit
52 data electrode driving circuit
53 scan electrode driving circuit
54 sustain electrode driving circuit
55 timing generating circuit
100 plasma display device

DETAILED DESCRIPTION OF PREFERRED EMBODIMENTS

A plasma display device in accordance with an exemplary embodiment of the present invention will be described hereinafter with reference to the accompanying drawings.

(Exemplary Embodiment)

FIG. 1 is an exploded perspective view showing a structure of panel 10 in accordance with the exemplary embodiment of the present invention. A plurality of display electrode pairs 24 formed of scan electrodes 22 and sustain electrodes 23 are disposed on glass-made front substrate 21. Dielectric layer 25 is formed so as to cover display electrode pairs 24, and protective layer 26 is formed on dielectric layer 25. A plurality of data electrodes 32 are formed on back substrate 31, dielectric layer 33 is formed so as to cover data electrodes 32, and double-cross-shaped barrier ribs 34 are formed on dielectric layer 33. Phosphor layers 35 for emitting lights of respective colors of red, green, and blue are formed on the side surfaces of barrier ribs 34 and on dielectric layer 33.

Front substrate 21 and back substrate 31 are faced to each other so that display electrode pairs 24 cross data electrodes 32 with a minute discharge space sandwiched between them. The outer peripheries of front substrate 21 and back substrate 31 are sealed by a sealing material such as glass frit. The discharge space is filled with discharge gas, for example, mixed gas of neon and xenon. Here, the xenon partial pressure is set at 10%, for example. The discharge space is partitioned into a plurality of sections by barrier ribs 34. Discharge cells are formed in the intersecting parts of display electrode pairs 24 and data electrodes 32. The discharge cells discharge and emit light to display an image.

The structure of panel 10 is not limited to the above-mentioned one, but may be a structure having striped barrier ribs, for example.

Figure 2:
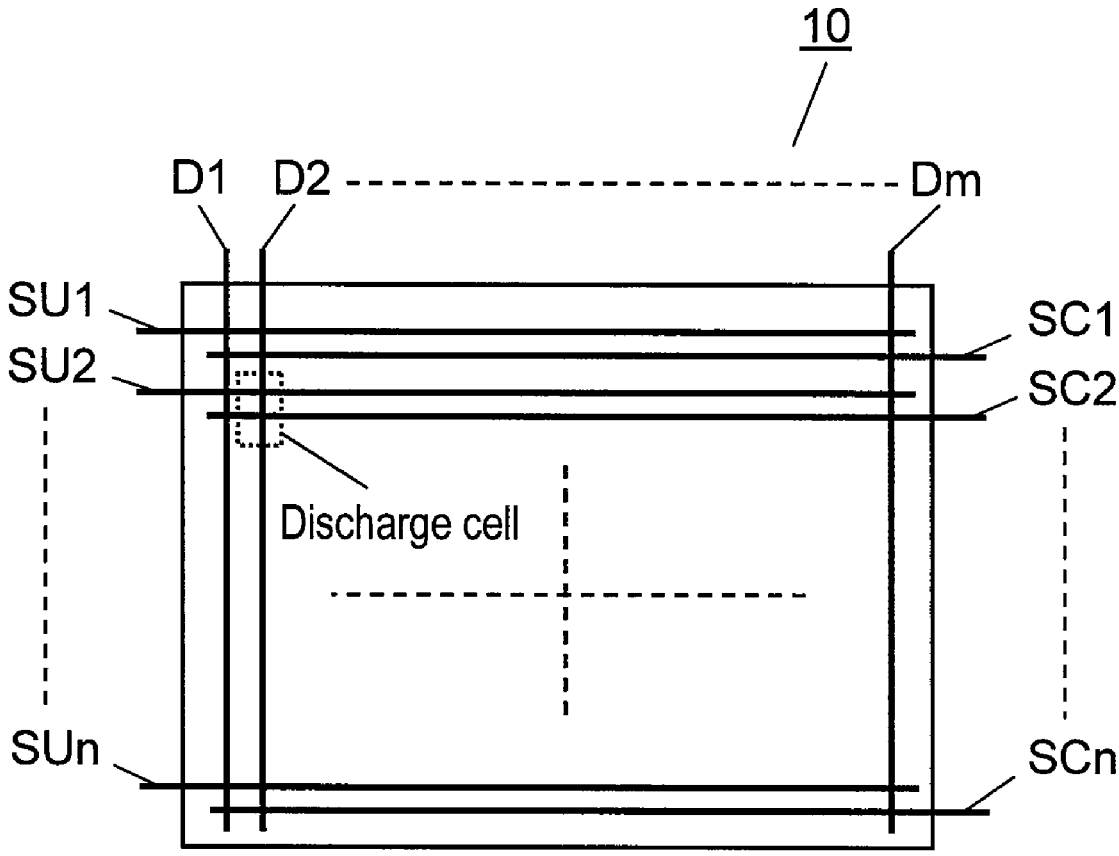
FIG. 2 is an electrode array diagram of the panel in accordance with the exemplary embodiment.

FIG. 2 is an electrode array diagram of panel 10 in accordance with the exemplary embodiment of the present invention. In panel 10, n scan electrodes SC1 through SCn (scan electrodes 22 in FIG. 1) and n sustain electrodes SU1 through SUn (sustain electrodes 23 in FIG. 1) long in the column direction are arranged, and m data electrodes D1 through Dm (data electrodes 32 in FIG. 1) long in the row direction are arranged. Each discharge cell is formed in the intersecting part of a pair of scan electrode SCi (i is 1 through n) and sustain electrode SUi and one data electrode Dj (j is 1 through m). In other words, the number of formed discharge cells in the discharge space is m×n. In the description of the present embodiment, "n" is assumed to be even. However, "n" may be odd.

Figure 3:
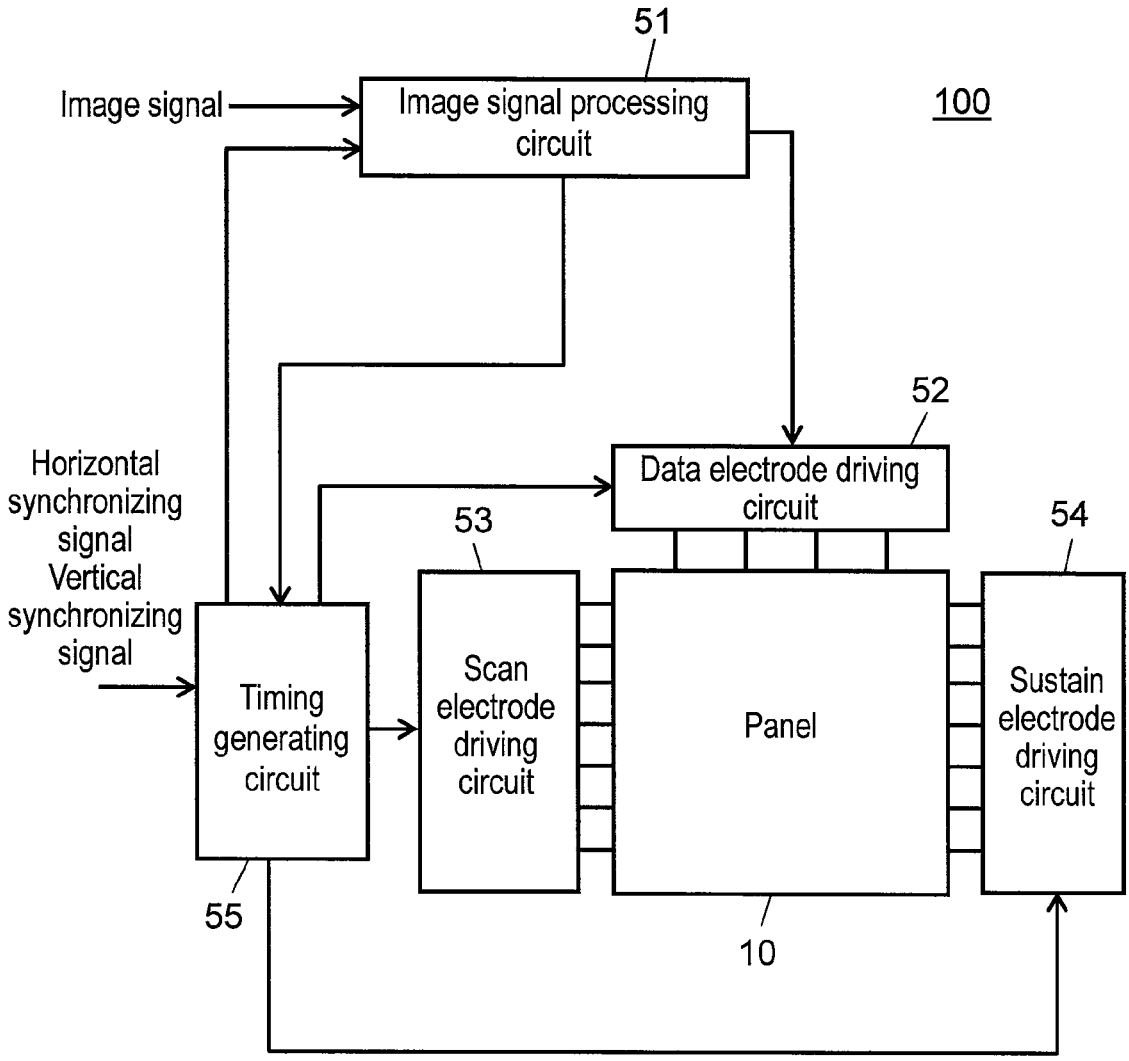
FIG. 3 is a circuit block diagram of a plasma display device in accordance with the exemplary embodiment.

FIG. 3 is a circuit block diagram of plasma display device 100 in accordance with the exemplary embodiment of the present invention. Plasma display device 100 has the following elements:

- panel 10;
- image signal processing circuit 51;
- data electrode driving circuit 52;
- scan electrode driving circuit 53;
- sustain electrode driving circuit 54;
- timing generating circuit 55; and
- a power supply circuit (not shown) for supplying power required for each circuit block.

Image signal processing circuit 51 converts an input image signal into image data that indicates emission or non-emission of light in each subfield. Data electrode driving circuit 52 converts the image data of each subfield into a signal corresponding to each of data electrodes D1 through Dm, and drives each of data electrodes D1 through Dm.

Timing generating circuit 55 generates various timing signals for controlling the operation of each circuit block based on a horizontal synchronizing signal and a vertical synchronizing signal, and supplies them to respective circuits. Scan electrode driving circuit 53 drives each of scan electrodes 22 based on the timing signal. Sustain electrode driving circuit 54 drives sustain electrodes 23 based on the timing signal.

Next, a driving voltage waveform for driving panel 10 and its operation are described. Plasma display device 100 performs gradation display by a subfield method. In this method, one field period is divided into a plurality of subfields, and emission and non-emission of light of each discharge cell are controlled in each subfield. Each subfield has an initializing period, an address period, and a sustain period.

In the initializing period, initializing discharge is performed to form, on each electrode, a wall charge required for a subsequent address discharge. In the initializing period, a priming (excitation particle as a detonating agent for discharge) for reducing discharge delay and stably causing address discharge is generated. The initializing operation at this time includes an all-cell initializing operation and a selection initializing operation. In the address period, address discharge is caused in a discharge cell to emit light, thereby forming a wall charge. In the sustain period, as many sustain pulses as the number corresponding to luminance weight are alternately applied to display electrode pairs 24, and sustain discharge is caused in the discharge cell having caused address discharge, thereby emitting light.

Figure 4:
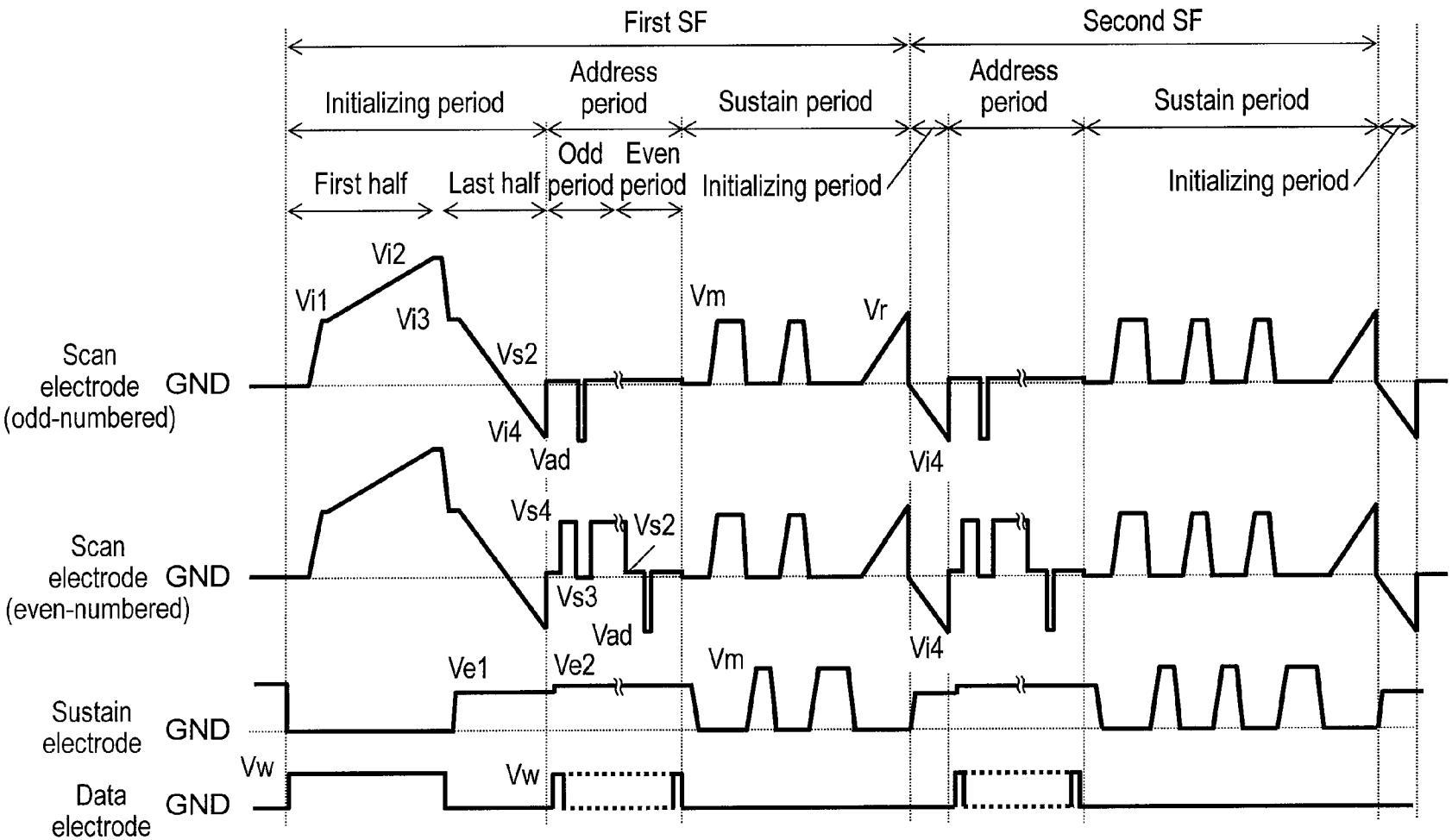
FIG. 4 is a waveform chart of driving voltage applied to each electrode of the panel in accordance with the exemplary embodiment.

Details on the subfield structure are described later. A driving voltage waveform to be applied to each electrode is firstly described. FIG. 4 is a waveform chart of driving voltage applied to each electrode of panel 10 in accordance with the exemplary embodiment of the present invention. FIG. 4 shows a first subfield (first SF) for performing the all-cell initializing operation, and a second subfield (second SF) for performing the selection initializing operation.

In the first half of the initializing period, voltage Vw is applied to data electrodes D1 through Dm, and voltage 0 (V) is applied to sustain electrodes SU1 through SUn. A gradually increasing ramp waveform voltage is applied to scan electrodes SC1 through SCn. Here, the ramp waveform voltage gradually increases from voltage Vi1, which is not higher than a discharge start voltage, to voltage Vi2, which is higher than the discharge start voltage, with respect to scan electrodes SC1 through SCn and sustain electrodes SU1 through SUn. The gradient of the ramp waveform voltage is set at 1.3 V/μsec, for example. While this ramp waveform voltage increases, feeble initializing discharge occurs between scan electrodes SC1 through SCn and sustain electrodes SU1 through SUn, and feeble initializing discharge occurs between scan electrodes SC1 through SCn and data electrodes D1 through Dm. Negative wall voltage is accumulated on scan electrodes SC1 through SCn, and positive wall voltage is accumulated on data electrodes D1 through Dm and sustain electrodes SU1 through SUn. Here, the wall voltage on the electrodes means the voltage generated by the wall charges accumulated on the dielectric layer covering the electrodes, the protective layer, and the phosphor layer.

In the last half of the initializing period, voltage 0 (V) is applied to data electrodes D1 through Dm, and positive voltage Ve1 is applied to sustain electrodes SU1 through SUn. A gradually decreasing ramp waveform voltage is applied to scan electrodes SC1 through SCn. Here, the ramp waveform voltage gradually decreases from voltage Vi3, at which the voltage difference between scan electrodes SC1 through SCn and sustain electrodes SU1 through SUn is not higher than the discharge start voltage, to voltage Vi4, at which the voltage difference is higher than the discharge start voltage. While the ramp waveform voltage decreases, feeble initializing discharge occurs between scan electrodes SC1 through SCn and sustain electrodes SU1 through SUn, and feeble initializing discharge occurs between scan electrodes SC1 through SCn and data electrodes D1 through Dm. Then, the negative wall voltage on scan electrodes SC1 through SCn and the positive wall voltage on sustain electrodes SU1 through SUn are reduced, positive wall voltage on data electrodes D1 through Dm is adjusted to a value suitable for the address operation. Thus, the all-cell initializing operation in which the initializing discharge is carried out in all discharge cells is completed.

In an odd period of the subsequent address period, voltage Ve2 is applied to sustain electrodes SU1 through SUn, second voltage Vs2 is applied to each of odd-numbered scan electrode SC1, scan electrode SC3, . . . , and scan electrode SCn−1, and fourth voltage Vs4 is applied to each of even-numbered scan electrode SC2, scan electrode SC4, . . . , and scan electrode SCn. Here, fourth voltage Vs4 is higher than second voltage Vs2.

Next, scan pulse voltage Vad is applied in order to apply a negative scan pulse to first scan electrode SC1. Positive address pulse voltage Vw is applied to data electrode Dk (k is 1 through m), of data electrodes D1 through Dm, in the discharge cell to emit light in the first column. At this time, in the present embodiment, third voltage Vs3 lower than fourth voltage Vs4 is applied to a scan electrode adjacent to scan electrode SC1, namely second scan electrode SC2. This prevents excessive voltage difference from being applied between adjacent scan electrode SC1 and second scan electrode SC2.

The voltage difference in the intersecting part of data electrode Dk of the discharge cell to which address pulse voltage Vw is applied and scan electrode SC1 is obtained by adding the difference between the wall voltage on data electrode Dk and that on scan electrode SCI to the difference (Vw−Vad) of the external applied voltage. The obtained voltage difference exceeds the discharge start voltage. Address discharge occurs between data electrode Dk and scan electrode SC1 and between sustain electrode SU1 and scan electrode SC1. Positive wall voltage is accumulated on scan electrode SC1, negative wall voltage is accumulated on sustain electrode SU1, and negative wall voltage is also accumulated on data electrode Dk. Thus, an address operation is performed that causes address discharge in the discharge cell to emit light in the first column and accumulates wall voltage on each electrode. The voltage in the intersecting parts of scan electrode SC1 and data electrodes D1 through Dm to which address pulse voltage Vw is not applied does not exceed the discharge start voltage, so that address discharge does not occur.

Regarding odd-numbered scan electrode SC3, scan electrode SC5, . . . , and scan electrode SCn−1, an address operation is performed similarly. Third voltage Vs3 is also applied to even-numbered scan electrode SCp (p is even number, $1<p<n$) and scan electrode SCp+2 that are adjacent to the odd-numbered scan electrode SCp+1 where the address operation is performed at this time.

In a subsequent even period, second voltage Vs2 is applied to even-numbered scan electrode SC2, scan electrode SC4, . . . , and scan electrode SCn while second voltage Vs2 is applied to odd-numbered scan electrode SC1, scan electrode SC3, . . . , and scan electrode SCn−1.

Next, scan pulse voltage Vad is applied in order to apply a negative scan pulse to second scan electrode SC2. Positive address pulse voltage Vw is applied to data electrode Dk, of data electrodes D1 through Dm, in the discharge cell to emit light in the second column. The voltage difference in the intersecting part of data electrode Dk of the discharge cell and scan electrode SC2 exceeds the discharge start voltage, and causes address discharge in the discharge cell to emit light in the second column, thereby performing an address operation of accumulating wall voltage on each electrode.

Regarding even-numbered scan electrode SC4, scan electrode SC6, . . . , and scan electrode SCn, an address operation is performed similarly.

In the subsequent sustain period, positive sustain pulse voltage Vm is firstly applied to scan electrodes SC1 through SCn, and voltage 0 (V) is applied to sustain electrodes SU1 through SUn. In the discharge cell having caused the address discharge, the voltage difference between scan electrode SCi and sustain electrode SUi is obtained by adding the difference between the wall voltage on scan electrode SCi and that on sustain electrode SUi to sustain pulse voltage Vm. The obtained voltage difference exceeds the discharge start voltage. Sustain discharge occurs between scan electrode SCi and sustain electrode SUi, and ultraviolet rays generated at this time cause phosphor layer 35 to emit light. Negative wall voltage is accumulated on scan electrode SCi, and positive wall voltage is accumulated on sustain electrode SUi. Positive wall voltage is also accumulated on data electrode Dk. In the discharge cell where address discharge does not occur in the address period, sustain discharge does not occur, and the wall voltage at the completion of the initializing period is kept.

Subsequently, voltage 0 (V) is applied to scan electrodes SC1 through SCn, and sustain pulse voltage Vm is applied to sustain electrodes SU1 through SUn. In the discharge cell having caused the sustain discharge, the voltage difference between sustain electrode SUi and scan electrode SCi exceeds the discharge start voltage. Therefore, sustain discharge occurs between sustain electrode SUi and scan electrode SCi again. Negative wall voltage is accumulated on sustain electrode SUi, and positive wall voltage is accumulated on scan electrode SCi. Hereinafter, similarly, as many sustain pulses as the number corresponding to the luminance weight are alternately applied to scan electrodes SC1 through SCn and sustain electrodes SU1 through SUn, and potential difference is caused between the electrodes of display electrode pairs 24. Thus, sustain discharge occurs continuously in the discharge cell that has caused the address discharge in the address period.

At the end of the sustain period, ramp waveform voltage gradually increases to voltage Vr that is equal to sustain pulse voltage Vm or higher than Vm is applied to scan electrodes SC1 through SCn. While the positive wall voltage is kept on data electrode Dk, wall voltages on scan electrode SCi and sustain electrode SUi are reduced. The gradient of the ramp waveform voltage is preferably set at 2 V/μsec-20 V/μsec, and is set at 10 V/μsec, for example. Thus, the sustain operation in the sustain period is completed.

In the initializing period of the second SF in which the selection initializing operation is performed, voltage Ve1 is applied to sustain electrodes SU1 through SUn, voltage 0 (V) is applied to data electrodes D1 through Dm, and a ramp waveform voltage gradually decreasing to voltage Vi4 is applied to scan electrodes SC1 through SCn. Thus, in the discharge cell that has caused the sustain discharge in the sustain period of the preceding subfield, feeble initializing discharge occurs, and the wall voltage on scan electrode SCi and sustain electrode SUi is reduced. Regarding data electrode Dk, sufficient positive wall voltage is accumulated on data electrode Dk by the immediately preceding sustain discharge, so that the wall voltage is discharged by the excessive amount and is adjusted to a wall voltage appropriate for the address operation. While, in the discharge cell that has not caused the sustain discharge in the preceding subfield, discharge is not performed and the wall charge at the completion of the initializing period of the preceding subfield is kept. Such selection initializing operation is an operation of selectively performing the initializing discharge in the discharge cell where a sustain operation is performed in the sustain period of the immediately preceding subfield.

The operation in the subsequent address period is similar to that in the address period of the first SF, so that the description of it is omitted. The operation in the subsequent sustain period is similar to that in the sustain period of the first SF except for the number of sustain pulses.

Figure 5:
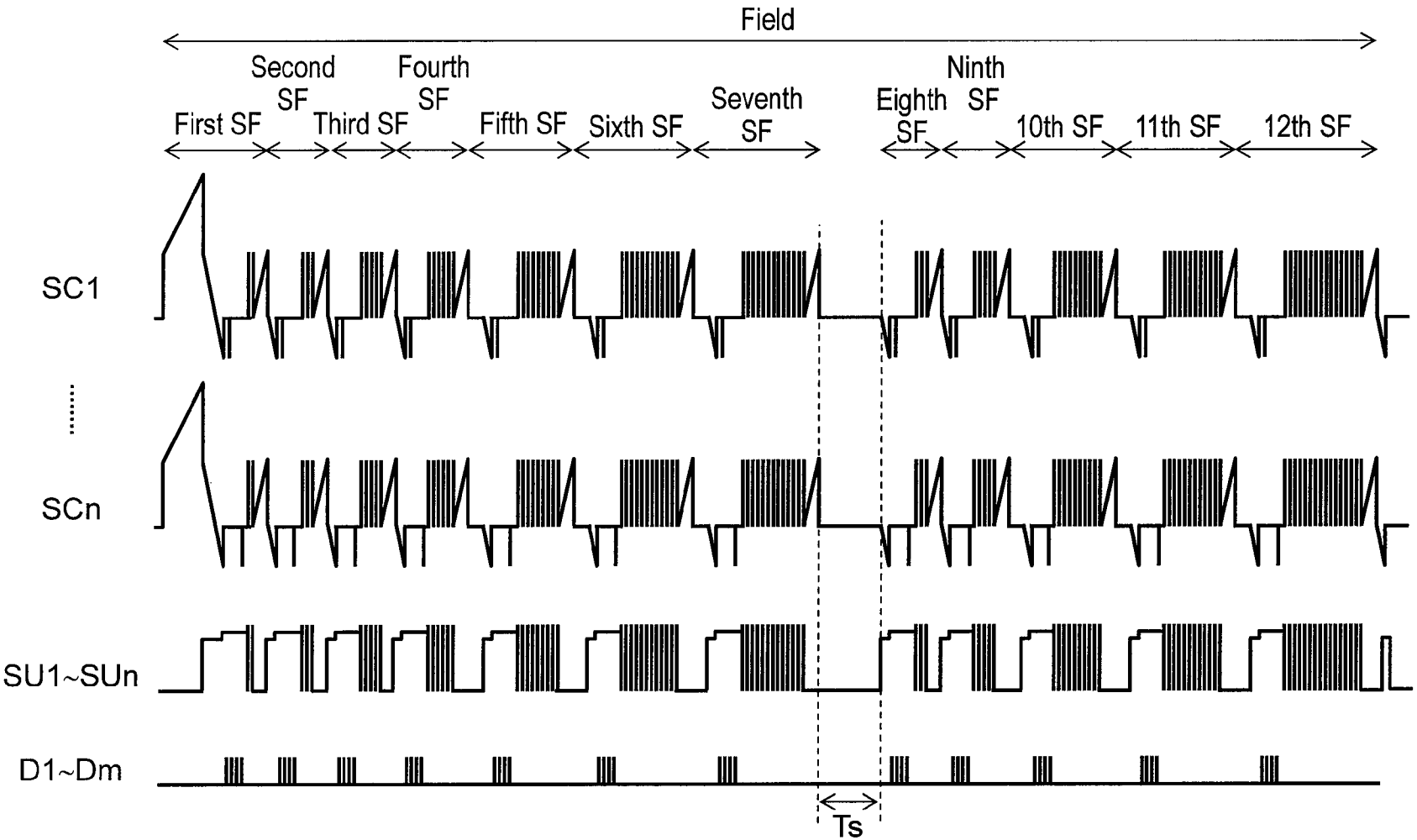
FIG. 5 is a diagram showing a subfield structure in accordance with the exemplary embodiment.

Next, the subfield structure of a plasma display device of the present exemplary embodiment is described. FIG. 5 is a diagram showing the subfield structure in accordance with the exemplary embodiment of the present invention. In the present embodiment, one field period is formed by arranging two subfield groups whose luminance weight monotonically increases. Specifically, one field period is divided into 12 subfields (first SF, second SF, . . . , 12th SF), and respective subfields have luminance weights of 1, 2, 4, 8, 16, 36, 56, 4, 8, 18, 40 and 62.

In the subfield structure of the present embodiment, first SF through seventh SF belong to a first subfield group, eighth SF through 12th SF belong to a second subfield group, and the subfields are arranged in each subfield group so that the luminance weights of the subfields monotonically increase. In other words, the luminance weights of first SF through seventh SF monotonically increase, the luminance weight of eighth SF decreases, and the luminance weights of eighth SF through 12th SF monotonically increase. Such an arranging method is effective in suppressing occurrence of flicker in an image signal of low field frequency, for example, in an image signal of a PAL (Phase Alternation by Line) method.

A holding period when discharge is not caused is disposed before the head subfield belonging to the second subfield group. The all-cell initializing operation is performed in the initializing period of the first SF, and the selection initializing operation is performed in the initializing period of the second SF through 12th SF.

Next, a display method of the gradation of the present embodiment is described. FIG. 6 is a diagram showing the relationship (hereinafter referred to as "coding") between the gradation to be displayed and existence of the address operation of the subfield at this time in the embodiment of the present invention. "1" shows that the address operation is performed, and "blank" shows that the address operation is not performed. The address operation is not performed in all of the first SF through 12th SF in the discharge cell of gradation "0", for example, namely showing black. Then, the luminance of the discharge cell becomes the lowest without sustain discharge. In the discharge cell showing gradation "1", the address operation is performed only in the first SF as a subfield having luminance weight "1", the address operation is not performed in other subfield. Then, the discharge cell causes as many sustain discharges as the number corresponding to luminance weight "1", and displays brightness of "1". In the discharge cell showing gradation "3", the address operation is performed in the first SF having luminance weight "1" and the second SF having luminance weight "2". Then, the discharge cell causes as many sustain discharges as the number corresponding to luminance weight "1" in the sustain period of the first SF, causes as many sustain discharges as the number corresponding to luminance weight "2" in the sustain period of the second SF, and hence displays brightness of "3" in total. Similarly, the address operation is performed in the first SF and third SF in the discharge cell showing gradation "5", and the address operation is performed in the first SF, second SF, and third SF in the discharge cell showing gradation "7". In the discharge cell showing gradation "11", the address operation is performed in the first SF, second SF, and third SF of the first subfield group, and also in the eighth SF of the second subfield group. In the discharge cell showing gradation "15", the address operation is performed in the first SF, second SF, and fourth SF of the first subfield group, and also in the eighth SF of the second subfield group. Also in the discharge cell showing other gradation, control is performed so that the address operation is performed or not performed in each subfield according to the coding of FIG. 6.

In the present embodiment, as shown in FIG. 6, the following control is performed. In the discharge cell causing address discharge in one of the second SF through seventh SF other than the head subfield belonging to the first subfield group, the address discharge is caused even in the head subfield, namely first SF. Similarly, in the discharge cell causing address discharge in one of the ninth SF through 12th SF other than the head subfield belonging to the second subfield group, the address discharge is caused even in the head subfield, namely eighth SF. In other words, in the discharge cell where the address operation has not been performed in the head subfield belonging to each subfield group, the address operation is not performed in the subfield belonging to the subfield group. In the present embodiment, showing the gradation using such a coding prevents an operation failure even in a high-definition panel, and achieves high-quality image display.

Next, the reason for this is described. Generally, occurrence of discharge generates positive and negative charged particles in discharge space. When the charged particles adhere to a wall of a discharge cell, the wall voltage is varied, the electric field strength inside the discharge space is varied to affect the discharge phenomenon. For example, when address discharge occurs in a discharge cell adjacent to the discharge cell where an address operation is not performed, a charged particle generated at this time can fly to the discharge cell where an address operation is not performed, and can reduce the wall voltage. This phenomenon is referred to as "charge drop off phenomenon". When the positive wall voltage on the data electrode required for the address operation excessively decreases, an operation failure that further address operation cannot be performed occurs, and the image display quality can be reduced.

The inventors experimentally verify that a charge drop off phenomenon is apt to occur in the address period after the all-cell initializing operation. Here, in the all-cell initializing operation, initializing discharge is generated by applying high voltage to all discharge cells. The sustain discharge is not caused in the subfield of a large luminance weight of the first subfield group in the discharge cell showing not so large gradation, so that the priming decreases in the head subfield of the second subfield group and the address margin decreases. Therefore, the charge drop off phenomenon is apt to occur also in the head subfield of the second subfield group. In addition, firstly, a gradually increasing ramp waveform voltage is applied to the scan electrode at the end of the sustain period. Secondly, the selection initializing operation of applying a gradually decreasing ramp waveform voltage is performed to a scan electrode. Finally it is experimentally verified that charge drop off phenomenon hardly occurs in the address period.

It is verified that the charge drop off phenomenon is apt to occur as the definition of the panel increases. That is considered to be because the size of the discharge cells is small and the amount of wall charge defining the wall voltage is also small in the high-definition panel, and hence the wall voltage significantly decreases even when the wall charge amount decreases slightly.

According to the coding of the present embodiment, when the address operation has not been performed in the head subfield of each subfield group, the address operation is not performed either in the subfield following the head subfield of the subfield group. Therefore, even when the wall voltage of the discharge cell where the address operation has not been performed in head address period of the subfield group decreases, the address operation is not performed in the subsequent subfield and hence the display image is not affected.

According to the coding of FIG. 6, gradations "2", "4", "6", etc. cannot be displayed, for example. However, these gradations can be displayed by changing the luminance weight of each subfield or adding a subfield having luminance weight "1". Alternatively, gradation may be artificially displayed by performing the image signal processing using an error diffusion method or dither method.

In the present embodiment, a holding period where discharge is not caused is disposed before the eighth SF as the head subfield of the second subfield group.

Figure 7:
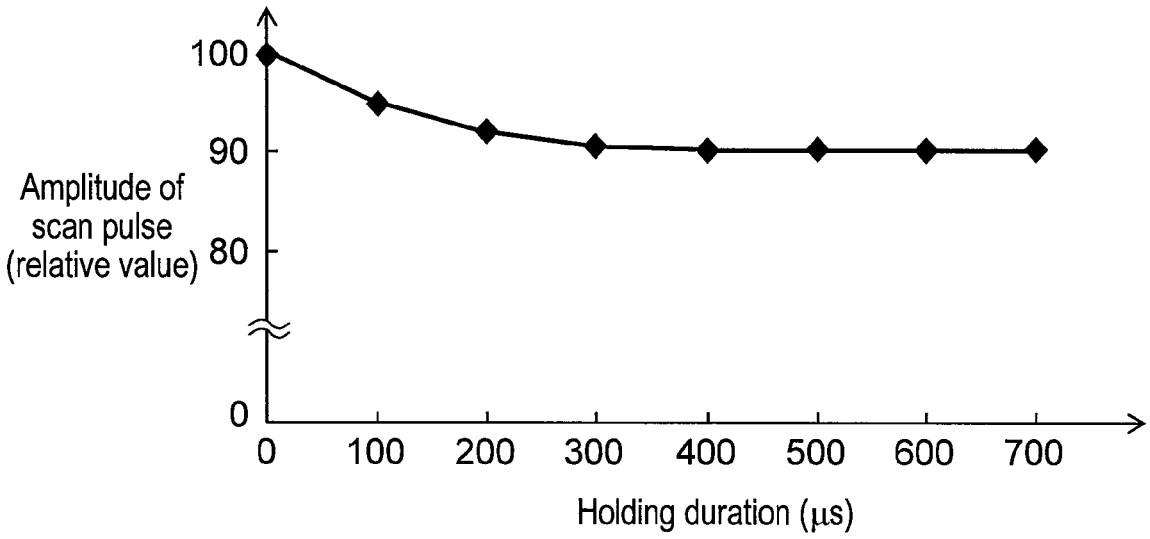
FIG. 7 is a diagram showing the relationship between the amplitude of a scan pulse required for performing stable address operation and a holding period.

FIG. 7 is a diagram showing the relationship between amplitude Vscn of a scan pulse required for performing a stable address operation and the duration (hereinafter referred to as "holding duration Ts") of a holding period. FIG. 7 shows the result obtained by measuring amplitude Vscn of a scan pulse required for compensating the reduction of the wall charge of a discharge cell and for performing the stable address operation while varying holding duration Ts. Here, amplitude Vscn of the scan pulse is equal to the difference between second voltage Vs2 and scan pulse voltage Vad. In other words, Vscn=Vs2−Vad.

According to the measurement result, amplitude Vscn of the scan pulse can be reduced by extending holding duration Ts. Specifically, as holding duration Ts is extended in the range of 0 μs to 300 μs, amplitude Vscn of the scan pulse can be reduced. However, even when holding duration Ts is extended beyond 400 μs, amplitude Vscn of the scan pulse can be hardly reduced. Therefore, it is preferable that holding duration Ts is set at 300 μs or longer. In the present embodiment, holding duration Ts is set at 400 μs. However, preferably, holding duration Ts is set appropriately in response to the discharge characteristic of the panel.

The reason why the selection initializing operation is stabilized by setting holding duration Ts in this manner is not completely understood, but can be considered as below. A gradually decreasing ramp waveform voltage is simply applied to scan electrodes SC1 through SCn in the selection initializing operation, so that only reduction of the positive wall voltage on data electrodes D1 through Dm is allowed. In the selection initializing operation, initializing discharge is caused in a localized region near the discharge gap between data electrodes D1 through Dm and scan electrodes SC1 through SCn or between scan electrodes SC1 through SCn and sustain electrodes SU1 through SUn. Therefore, when unnecessary wall charge is accumulated on the periphery of a discharge cell for some reason, the unnecessary wall charge can remain.

In the selection initializing operation, the wall voltage accumulated by the sustain discharge in the immediately preceding subfield is adjusted, and wall voltage required for the subsequent address operation is obtained. Whether appropriate wall voltage can be formed in the selection initializing operation largely depends on the state of the wall charge accumulated by the last discharge (erasing discharge) of the sustain period. After the completion of the erasing discharge, however, many primings of the sustain discharges occurring before then remain. As a result, if the selection initializing operation is performed at this time, the selection initializing operation cannot be always performed normally for the following reasons:

- the wall charge on data electrodes D1 through Dm excessively decreases due to influence of these primings; and
- unnecessary wall charge is accumulated inside the discharge cell by the noise voltage overlaid on each electrode.

Such phenomenon is apt to occur when sustain discharge occurs in a discharge cell where sustain discharge is not performed and in a discharge cell adjacent to it.

Therefore, when one field period is formed by arranging a plurality of subfield groups having a plurality of subfields whose luminance weight monotonically increases, the possibility that the address operation is not stably performed in the head subfield of the second subfield group or later, namely in the eighth SF in the present embodiment, becomes high.

In the present embodiment, however, after the completion of the erasing discharge in the immediately preceding subfield of the head subfield of the second subfield group, namely in the seventh SF, voltages applied to data electrodes D1 through Dm, scan electrodes SC1 through SCn, and sustain electrodes SU1 through SUn are kept for predetermined holding duration Ts. The gradually decreasing ramp waveform voltage is applied to scan electrodes SC1 through SCn after disappearance of the priming by the sustain discharge in the seventh SF, so that stable selection initializing operation is considered to be allowed without being affected by the sustain discharge in the immediately preceding subfield.

As shown in FIG. 5, in the first subfield group, the period (hereinafter referred to as "pause period") when 0 V is applied to scan electrodes SC1 through SCn is disposed between the ramp waveform voltage applied to scan electrodes SC1 through SCn at the end of the sustain period of the fourth SF and the ramp waveform voltage applied to scan electrodes SC1 through SCn for the selection initializing operation in the fifth SF. In other words, the pause period is disposed at the beginning of the initializing period of the fifth SF. In the pause period, 0 V is applied to sustain electrodes SU1 through SUn and data electrodes D1 through Dm.

Similarly, a pause period is disposed at the beginning of the initializing period of the sixth SF, and a pause period is disposed at the beginning of the initializing period of the seventh SF. Also in the second subfield group, a pause period is disposed at the beginning of the initializing period of the 10th SF, a pause period is disposed at the beginning of the initializing period of the 11th SF, and a pause period is disposed at the beginning of the initializing period of the 12th SF. Thus, a pause period is disposed in at least one subfield of the subfields that constitute one field period and do not include the head subfields of the first subfield group and the second subfield group. In this pause period, similarly in the holding period, discharge does not occur.

By disposing such a pause period, an advantage similar to that obtained by disposing the holding period can be obtained. As shown in FIG. 5, holding duration Ts is set to be longer than the length (pause duration) of the pause period. In other words, the length (holding duration Ts) of the holding period disposed between the eighth SF and the seventh SF as the subfield having the largest luminance weight of the first SF through 11th SF other than the 12th SF is set to be longer than the pause duration. That is because the selection initializing operation performed after the erasing discharge of the subfield having large luminance weight is more apt to become unstable comparing with the subfield having small luminance weight. After the erasing discharge of the 12th SF, the all-cell initializing operation is performed and then the address operation is performed. Therefore, even when the selection initializing operation is performed after the erasing discharge of the 12th SF and before the all-cell initializing operation, and the selection initializing operation becomes somewhat unstable, the display quality is hardly affected.

Thus, in the present embodiment, one field period is formed by arranging a plurality of subfield groups having a plurality of subfields that are arranged so that the luminance weight monotonically increases. In the discharge cell for causing address discharge in some subfield other than the head subfield in each subfield group, address discharge is caused even in the head subfield. A holding period when discharge is not caused is disposed before the head subfield belonging to at least one subfield group of the plurality of subfield groups. In the initializing period of the head subfield belonging to at least one subfield group, an initializing operation of causing initializing discharge is performed in the discharge cell where the sustain discharge has been performed in the sustain period of the immediately preceding subfield. Thus, even a high-definition panel can display a high-quality image without causing an operation failure.

Various specific numerical values used in the present embodiment are just one example, and are appropriately set at the optimal values in response to the characteristic of the panel, the specification of the plasma display device, and the like.

Industrial Applicability

The present invention is useful as a driving method of a panel that does not cause an operation failure even in the high-definition panel and allows high-quality image display.

The invention claimed is:

1. A driving method of a plasma display panel, the plasma display panel having a plurality of discharge cells, each of the discharge cells having a data electrode and a display electrode pair that includes a scan electrode and a sustain electrode, wherein one field period is formed by arranging a plurality of subfields, each of the subfields having:

an initializing period for causing initializing discharge in the discharge cell;

an address period for selectively causing address discharge in the discharge cell; and a sustain period for causing as many sustain discharges as the number corresponding to luminance weight in the discharge cell, the method comprising:

forming the one field period by arranging a plurality of subfield groups having a plurality of subfields that are arranged so that the luminance weight monotonically increases;

forming a holding period when discharge is not caused before a head subfield belonging to at least one subfield group of the plurality of subfield groups, wherein a length of the holding period is set to reduce an amplitude of a scan pulse applied to the scan electrode from a first voltage level to a second voltage level; and performing an initializing operation of causing initializing discharge in a discharge cell where sustain discharge has been performed in a sustain period of an immediately preceding subfield in the initializing period of the head subfield belonging to at least the one subfield group, wherein an initializing period in at least one subfield includes an all-cell initializing period for performing the all-cell initializing operation and an other initializing period in at least one other subfield includes a selection initializing period for performing the selection initializing operation;

wherein in a first half of the all-cell initializing period, an increasing ramp waveform voltage having a voltage greater than a discharge start voltage is applied to the scan electrode, in a last half of the all-cell initializing period, a decreasing ramp waveform voltage having a voltage greater than the discharge start voltage is applied to the scan electrode;

wherein in the selection initializing period, a decreasing ramp waveform voltage is applied to the scan electrode; and wherein in an odd period of the address period, a scan pulse voltage is applied to odd-numbered scan electrodes, and in an even period of the address period, the scan pulse voltage is applied to even-numbered scan electrodes.

2. The driving method of the plasma display panel of claim 1, wherein a pause period when discharge is not caused is disposed at a beginning of the initializing period in at least one subfield of subfields that constitute one field period and except the head subfield of each subfield group, and length of the holding period is set to be longer than length of the pause period.

3. The driving method of the plasma display panel of claim 1, wherein in the sustain period, a sustain pulse is applied to the display electrode pair, then an increasing ramp waveform voltage is applied to the scan electrode.

4. The driving method of the plasma display panel of claim 1, wherein the holding period is 300 μs or longer.

* * * * *